US006242684B1

(12) United States Patent
Oliver et al.

(10) Patent No.: US 6,242,684 B1
(45) Date of Patent: Jun. 5, 2001

(54) SHOCK HARDENING DEVICE FOR TORPEDO-MOUNTED DISPENSERS ON TORPEDOES

(75) Inventors: Stephen F. Oliver, Portsmouth; Stanley J. Olson, Newport, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/310,689

(22) Filed: May 10, 1999

(51) Int. Cl.[7] ..... F42B 19/00
(52) U.S. Cl. ..... 114/20.1; 89/1.81
(58) Field of Search ..... 114/20.1, 238, 114/239; 89/1.801, 1.806, 1.809, 1.81, 1.816

(56) References Cited

U.S. PATENT DOCUMENTS 3,072,022 * 1/1963 Wood et al. ..... 89/1.81
3,335,757 * 8/1967 Lynch ..... 114/20.1
3,364,896 * 1/1968 Hedenberg ..... 114/238
3,387,537 * 6/1968 Chakoian et al. ..... 114/20.1
3,395,670 * 8/1968 Betzold ..... 114/238
4,627,327 * 12/1986 Huber ..... 89/1.81
4,739,691 * 4/1988 Beutter et al. ..... 89/1.801
4,878,416 * 11/1989 Orquera et al. ..... 89/1.81
5,065,688 * 11/1991 Moody ..... 114/238
5,327,809 * 7/1994 Matterson et al. ..... 89/1.816
5,353,677 * 10/1994 Kennedy ..... 89/1.816
5,400,689 * 3/1995 Hutter et al. ..... 89/1.816
5,690,044 * 11/1997 Reise et al. ..... 114/20.1

* cited by examiner

*Primary Examiner*—Michael J. Carone
*Assistant Examiner*—Denise J. Buckley
(74) *Attorney, Agent, or Firm*—Michael J. McGowan; Robert W. Gauthier; Prithvi C. Lall

(57) ABSTRACT

Three extender assemblies are mounted on the torpedo-mounted dispenser (TMD) of a torpedo to provide shock hardening of the TMD. In a first embodiment, the extender assemblies consist of short sections of metal tubes mounted on inner plate portions. The inner plate portions are bent to conform to the TMD radius and attach to the TMD such that the metal tubes are aligned longitudinally on the TMD. Outer plates are attached to the tubes and are in contact with the dolly used to support the torpedo and TMD. When the dolly the TMD is subjected to a shock load, the tubes deform to take up shock loads applied to the TMD through the dolly. To attach the assemblies to the TMD, slots on each inner plate are positioned over hooks on the outside surface of the TMD. The hooks are part of the TMD assembly and serve to secure o-ring or spring retainers for the cable within the TMD. An eye bolt fits over the hook and is bolted to a bent tab on the inner plate. To facilitate loading of the TMD into or out of the dolly, the ends of the tubes and plates are chamfered. In a second embodiment, the tubes are aligned circumferentially about the TMD.

21 Claims, 6 Drawing Sheets

SHOCK HARDENING DEVICE FOR TORPEDO-MOUNTED DISPENSERS ON TORPEDOES

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to munitions storage and in particular to torpedo shock protection devices.

(2) Description of the Prior Art

The heavy weight torpedoes, MK 48, MK48/ADCAP, and MK48/ADCAP/TPU, contain wire payout communication systems. These wire communication systems have two wire payout coils, a torpedo payout coil contained in the fuel tank and a submarine tube mounted payout coil which is attached to the tail of the torpedo in a torpedo-mounted dispenser (TMD) during stowage and tube loading. As a single, continuous wire is used for communication with the torpedo, part of which is wound within the torpedo and part of which is wound in the TMD which remains attached to the submarine when the torpedo is launched, it is necessary to transport and store both the torpedo and the TMD together. The current procedure is to attach the TMD to the torpedo drive shaft, thereby forming a single assembled unit for transport and storage operations. This assembly is shown in FIG. 1. The TMD 102 contains a flexible outer shell 104, surrounding a coiled flexible hose 106. Both the flexible hose 106 and communications wire (not shown) are coiled within the TMD and payed out as the torpedo 108 is launched. The entire TMD 102 adds considerable weight to the tail of the torpedo 108. During storage, transportation, and stowage in the torpedo room with the TMD 102 assembled onto the torpedo, any shock and vibration can have detrimental effects on the torpedo after body assembly. The TMD 102 and its isolation mount with ball release mechanism are attached to the torpedo drive shaft through the exhaust valve housing and bellmouth adapter housing 110. Using a torpedo dolly to support the TMD 102 has been unsatisfactory due to the relative fragility of the TMD 102 when supported around the outer shell 104. The current fleet torpedo stowage configurations, i.e., without the TMD 102 being strapped down, may not survive operational shock specifications, e.g., shock loads imposed on the torpedo 108 by the submarine stowage system when the submarine comes under depth charge or torpedo attack.

An ADCAP Warshot Propulsion Layout Assembly with the TMD 102 mounted on the propulsion shaft with the bell-mounted adapter is shown in FIG. 2. The torpedo 108 is stowed in a torpedo room and the torpedo 108 is strapped down to the stowage deck 112 in the submarine. A standard torpedo dolly 114, shown in an end view in FIG. 3, supports TMD 102 with a generic (crushable honeycomb) material 116 between dolly 114 and Tmd 102. Even with honeycomb material 116 in place, shock and vibration caused primarily by wartime explosions can damage and/or disable the weapon in the stowage position. Once the propulsion unit is loaded into the torpedo tube, the TMD 102 remains attached to the inside of the tube door only and the vehicle is free to be launched separately. Shock protection is only required prior to loading in the torpedo tube, that is, during torpedo room storage or during transport. It is not possible to merely strap the TMD 102 directly to a support, such as the torpedo dolly 114, and secure the support to the stowage rack because the exterior of the TMD 102, i.e. outer shell 104, can only sustain limited loads. Additionally, certain locations on the TMD 102 can support relatively high loads, such as at the foot support 118 of dolly 114, whereas other locations are relatively fragile. A protective structure, which can provide varying degrees of support, is needed between the torpedo dolly 114 and the TMD 102. The supports must withstand the clamping loads of the torpedo dolly 114 without damage and also satisfy the shock requirements.

SUMMARY OF THE INVENTION

Accordingly, it is an object of the present invention to provide a shock absorbing device which can be attached to and surround a torpedo-mounted dispenser and which can then be clamped down using a torpedo dolly.

Another object of the present invention is to provide a shock-absorbing device which has varying degrees of crushability at different locations.

Still another object of the present invention is to provide a shock-absorbing device, which can be readily adapted and attached to existing torpedo-mounted dispensers of varying diameters without altering other components of the stowage and handling systems.

Other objects and advantages of the present invention will become more obvious hereinafter in the specification and drawings.

In accordance with the present invention, three extender assemblies are mounted on the TMD. In a first embodiment, the extender assemblies consist of short sections of metal tubes mounted longitudinally on the TMD. When the dolly holding the TMD is subjected to a shock load, the tubes deform to take up shock loads applied to the TMD through the dolly. The tubes are mounted to inner plate portions which are bent to conform to the TMD radius. Outer plates are attached to the tubes and are in contact with the dolly. To attach the assemblies to the TMD, a slot of each inner plate is positioned over a hook on the outside surface of the TMD. The hooks are part of the TMD assembly and serve to secure tie down straps for the cable within the TMD. An eye bolt fits over the hook and is bolted to a bent tab on the plate. To facilitate loading of the TMD into and out of the dolly, the ends of the tubes and plates are chamfered. In a second embodiment, the tubes are aligned circumferentially about the TMD.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 4:
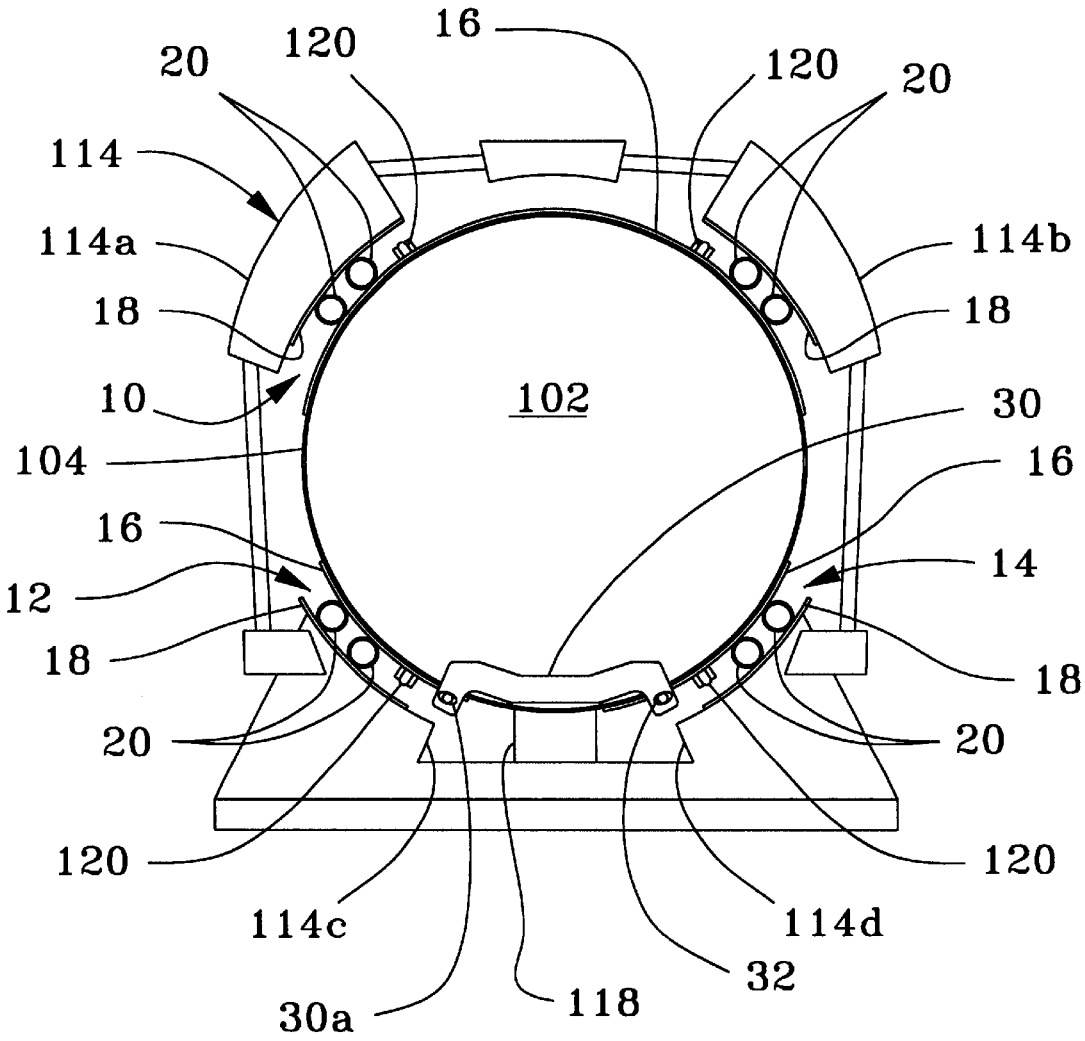
FIG. 4 is a cross-section of a TMD with the shock-hardening device of the present invention attached.

Referring now to FIG. 4, there is shown a cross-section of TMD 102 within torpedo dolly 114. For clarity, only outer shell 104 of TMD 102 is shown. The shock hardening device of the present invention consists of three extender assemblies, 10, 12 and 14, which mount onto TMD 102 and provide support for outer shell 104 against torpedo dolly 114 at dolly supports 114a-d. Top extender assembly 10 is in contact with, and spans between, upper supports 114*a* and 114*b* and lower extender assemblies 12 and 14 are in contact with lower supports 114*c* and 114*d*, respectively. Each extender assembly has an inner plate 16 and an outer plate 18. Inner plates 16 are bent to conform to the radius of outer shell 104 and outer plates 18 are bent to conform to the radius of dolly 114. Metal tubes 20 are aligned longitudinally with TMD 102 and fixed between inner and outer plates 16 and 18. The diameter and thickness of tubes 20 are chosen not only to conform to the space between TMD 102 and dolly 114, but also to provide sufficient stiffness to TMD 102 to withstand the expected shock loads, and such that the tubes 20 deform to absorb the load and prevent damage to TMD 102. In addition, the tubes also support the clamping loads of torpedo dolly 114 and foot support 118.

Figure 3:
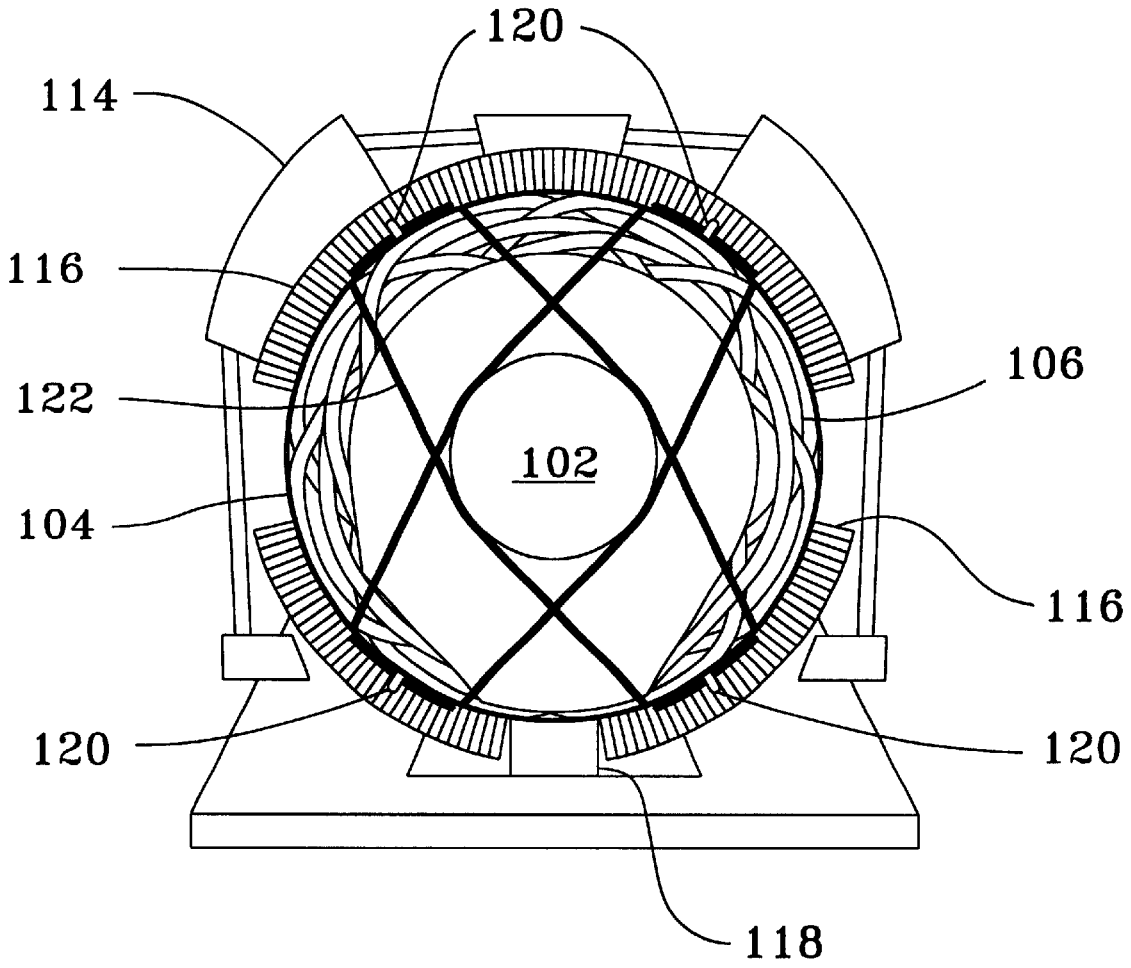
(PRIOR ART) FIG. 3
FIG. 3 is a cross-section of a TMD and prior art shock-hardening device.
Figure 5:
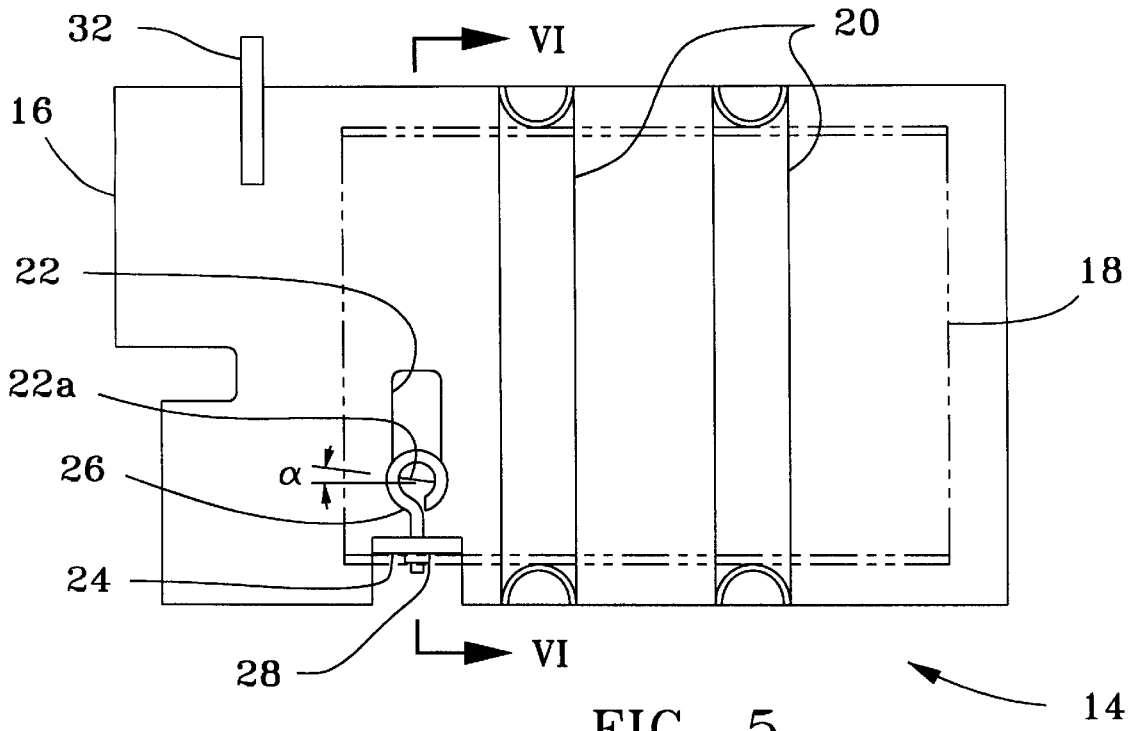
FIG. 5 is an elevational view of an extender assembly of the present invention.

Referring now also to FIG. 5, an elevational view of lower extender assembly 14 is shown with outer plate 18 in phantom. The view of FIG. 5 is such that inner plate 16 is shown projected onto a flat plane. In order to preclude even slight modifications to TMD 102, the shape of inner plate 16 and its attachment to outer shell 104 is made to conform to the existing geometry of outer shell 104. Outer shell 104 has four hooks 120 (shown in FIGS. 3 and 4) spaced about its exterior. The hooks 120 are used to secure o-ring or spring retainers 122 for flexible hose 106 (shown in FIG. 3). To secure extender assembly 14 to outer shell 104, a slot 22 is made in inner plate 16, such that, when extender assembly 14 is placed on outer shell 104, hook 120 protrudes through slot 22. A tab 24 on inner plate 16 is longitudinally aligned with slot 22 and is bent 90° out of the plane of FIG. 5 and away from outer shell 104. An eye bolt 26 is placed over hook 120, passing through tab 24. When nut 28 is tightened, extender assembly 14 is firmly secured to outer shell 104.

Figure 1:
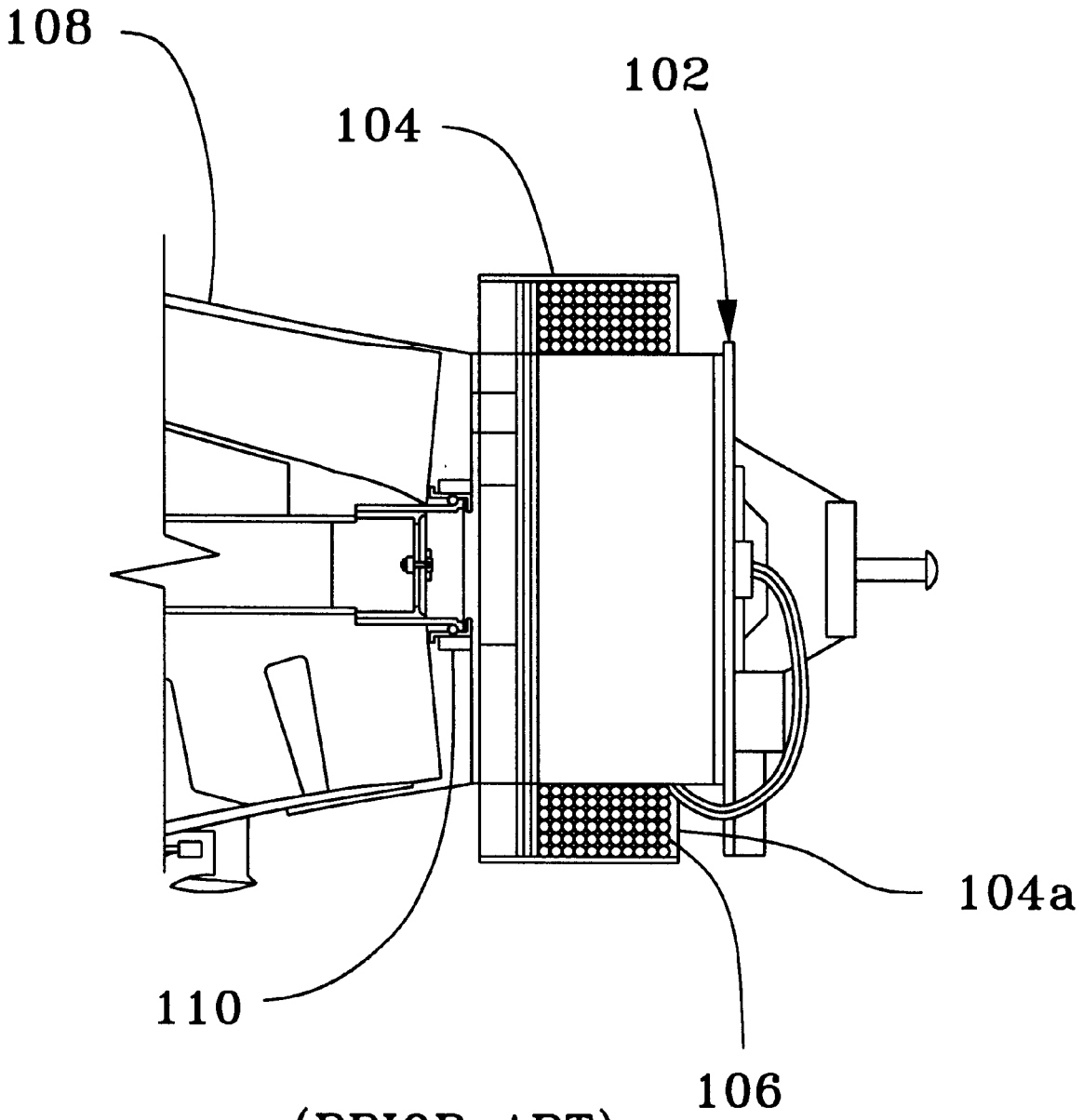
(PRIOR ART) FIG. 1
FIG. 1 is a cross-sectional partial side view of a torpedo with a torpedo-mounted dispenser (TMD) attached.
Figure 2:
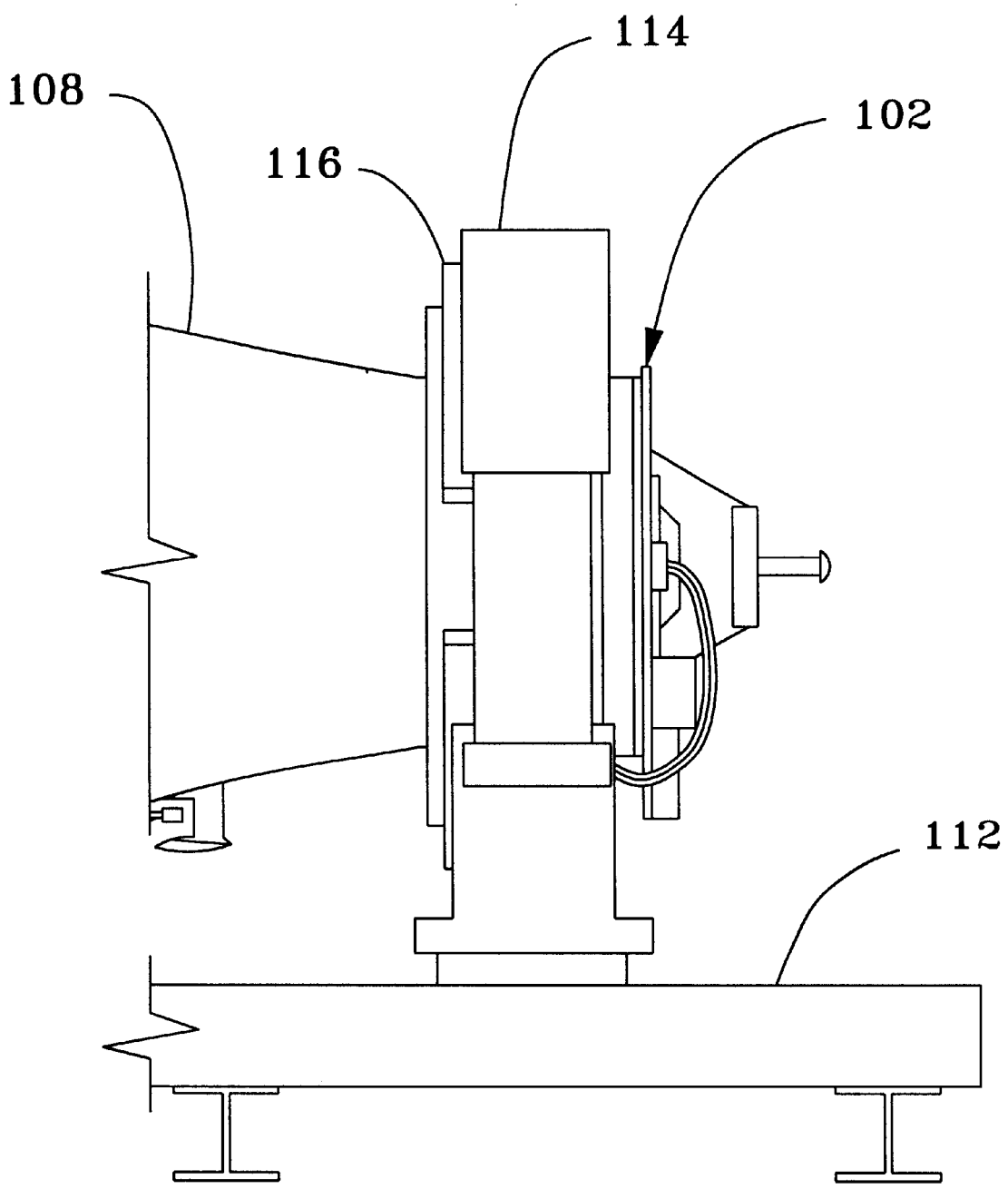
(PRIOR ART) FIG. 2
FIG. 2 is a side view of the aft end of a torpedo shown in a torpedo stowage room with a TMD attached and a torpedo dolly supporting the TMD.
Figure 6:
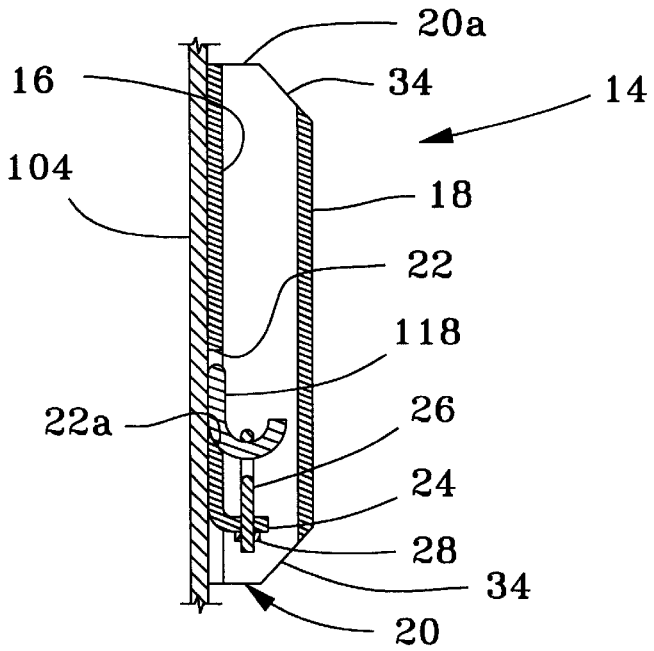
FIG. 6 is a cross section through an extender assembly of the present invention taken at line VI—VI of FIG. 5.

FIG. 6 shows a cross section through extender assembly 14 taken at line VI—VI of FIG. 5 to better illustrate the hook-slot arrangement. Outer plate 18 is also shown in FIG. 6 to indicate the clearance between hook 120 and outer plate 18. Hook 120 extends sufficiently through slot 22 such that eye bolt 26 can be attached. Eye bolt 26 passes through tab 24 and is secured with nut 28. As nut 28 is tightened, tab 24 and hook 120 are brought closer together until lower edge 22a of slot 22 is wedged underneath hook 120. In order to further enhance this wedging action, lower edge 22a may have a slight chamfer, or may be machined with a slight incline to the horizontal (angle $\alpha$ as shown in FIG. 5). When nut 28 is tightened against this slight incline, assembly 14 is moved in a direction towards foot support 118. FIG. 4 also shows stabilizer bar 30 which connects between lower assemblies 12 and 14. A stud 32 is attached to each lower assembly 12 and 14 and extends past the end 104a (FIG. 1) of outer shell 104. It is noted here that assemblies 10–14 also protrude beyond end 104*a*. Stabilizer bar 30 has two slots 30*a* which fit over studs 32 such that stabilizer bar 30 can be bolted between assemblies 12 and 14. In this manner, assemblies 12 and 14 are tied together by stabilizer bar 30 thus further securing assemblies 12 and 14 to outer shell 104 as nuts 28 are tightened.

When extender assemblies 10–14 are all in place, retainer 122 (FIG. 3) is placed over flexible hose 106 (FIG. 3), through slots in outer shell 104 (not shown) and over hook 120. It is to be noted that upper extender assembly 10 and lower extender assembly 12 include similar slots, tabs and eye bolts for securing extender assemblies 10 and 12 to outer shell 104, upper assembly 10 having two slots 22 as it spans over two hooks 120.

FIG. 6 also shows chamfers 34 cut into metal tubes 20 and outer plate 18. The chamfers 34 are provided at both ends of tubes 20. From a point approximately midway on the faces 20a of metal tubes 20, each chamfer 34 slopes up away from TMD 102 and into the projection of assembly 14. When the torpedo 108 and TMD 102, together with extender assemblies 10–14, are to be loaded into, or withdrawn from a torpedo tube (not shown), the chamfers 34 allows for slight misalignments between the extender assemblies 10-14 and the torpedo tube or torpedo dolly without the outer plates 18 of the extender assemblies 10–14 binding in the torpedo tube or torpedo dolly.

The invention thus described provides shock hardening for existing TMD's restrained in torpedo dollies. The three extender assemblies of the device fit over the flexible tube of the TMD at the torpedo dolly support points. Each assembly has an inner plate which is secured against the flexible tube and an outer plate which fits against one or more of the dolly supports. Metal tubes are fixed between the plates so as to align with the longitudinal axis of the TMD and torpedo. The extender assemblies provide sufficient strength to the TMD to resist shock loads below a predefined limit without damage. When a shock load is transmitted from the torpedo dolly to the TMD which exceeds the predefined limit, the metal tubes collapse under the load to prevent damage to the TMD. No modifications are required to existing TMD's to secure the extender assemblies to the TMD's.

Although the present invention has been described relative to a specific embodiment thereof, it is not so limited. For example, metal tubes 20 may be preloaded by fabricating them with an elliptical cross section. Such preloading allows for more precise control of the shock load at which the metal tubes 20 will deform. The assemblies 10–14 may also be fabricated without outer plates 18. In this embodiment, tubes 20 rest against dolly supports 114*a–d*. The stability and load distribution provided by outer plates 18 may not be necessary for some TMD and dolly configurations.

Figure 7:
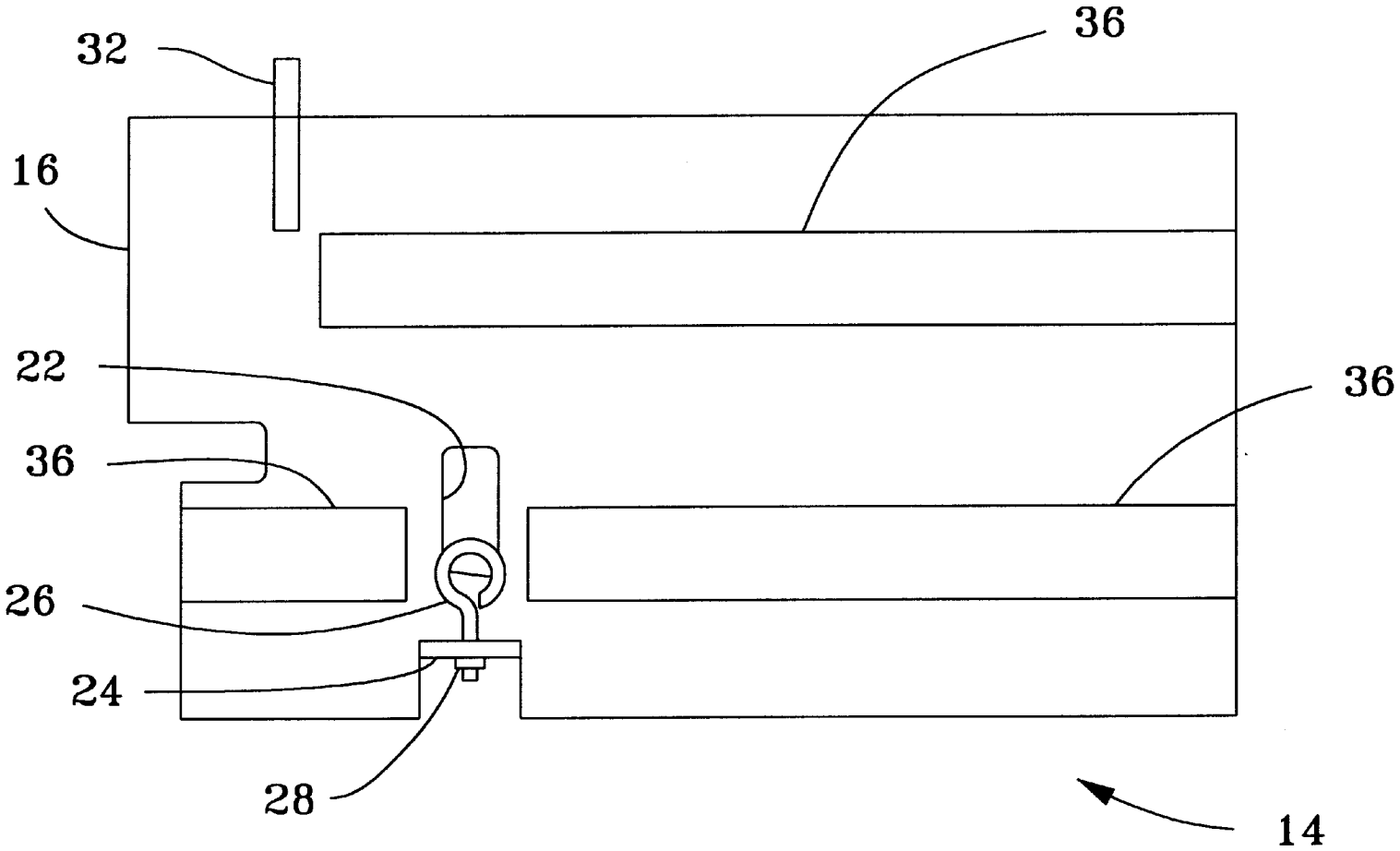
FIG. 7 is an elevational view of an extender assembly of a second embodiment of the present invention.

In another embodiment, shown in the elevational view of FIG. 7, similar to that of FIG. 5, the longitudinally aligned metal tubes 20 have been replaced with circumferential metal tubes 36. As with longitudinal tubes 20, the diameter, thickness and placement of circumferential tubes 36 will depend on the magnitude of the predefined shock load. The embodiment of FIG. 7 has a number of advantages over the longitudinal tube embodiment. Because the circumferential metal tubes 36 wrap around outer shell 104 of TMD 102, they provide sufficient stiffness to outer shell 104 such that outer plate 18 is not required. Additionally, chamfer 34 is not required as the radius of the circumferential tubes 36 presents a natural chamfer when loading into a torpedo tube. However, bending of the circumferential tubes 36 to properly correspond to the radius of outer shell 104 creates fabrication problems not found in the longitudinal tube embodiment.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A shock-hardening device for torpedo-mounted dispensers comprising:

at least one inner support circumferentially attached to a torpedo-mounted dispenser; and at least one shock-absorbing tube affixed to said inner support and aligned longitudinally with a longitudinal axis of said dispenser, said shock-hardening device stiffening the torpedo-mounted dispenser so as to sustain a predefined value of a shock load without damage to the dispenser, said tubes deforming to prevent damage to the dispenser when the shock load exceeds the predefined value.

2. A shock-hardening device for torpedo-mounted dispensers as in claim 1, wherein said at least one inner support comprises a metal plate. bent to correspond to a radius of said torpedo-mounted dispenser.

3. A shock-hardening device for torpedo-mounted dispensers as in claim 1, further comprising at least one outer support affixed to a diametrically opposite sipde of said at least one shock-absorbing tube from said inner support, said outer support being a metal plate bent to a radius corresponding with a radius of said torpedo-mounted dispenser plus a width of said at least one tube.

4. A shock-hardening device for torpedo-mounted dispensers as in claim 2, further comprising at least one outer support affixed to a diametrically opposite side of said at least one shock absorbing tube from said inner support, said outer support being a metal plate bent to a radius corresponding with a radius of said torpedo-mounted dispenser plus a width of said at least one tube.

5. A shock-hardening device for torpedo-mounted dispensers as in claim 4, wherein each said shock-absorbing tube is fabricated with an elliptical cross section, said elliptical cross section preloading said tubes to deform at said predefined value of the shock load.

6. A shock-hardening device for torpedo-mounted dispensers as in claim 4, wherein each end of each said shock absorbing tube is chamfered in a direction away from the torpedo-mounted dispenser and towards a center point of the tube, the chamfer being incorporated into edges of each outer support adjacent the tubes.

7. A shock-hardening device for torpedo-mounted dispensers as in claim 4, wherein said at least one inner support further comprises:

at least one tab extending radially outward from said at least one inner support;

a slot adjacent each said tab, each slot corresponding to a hook on said dispenser, the hook extending through said slot when said inner support is placed on said dispenser;

an eye bolt engaging said hook and extending through a bolt hole on said tab; and a nut engaging said extension of said eye bolt through said tab, tightening of said nut on said eye bolt against said tab bringing said inner support in contact with said hook, said contact serving to attach said inner support to the dispenser.

8. A shock-hardening device for torpedo-mounted dispensers as in claim 7, wherein said contact is made at an edge of said slot, said edge being chamfered to wedge said inner support beneath said hook.

9. A shock-hardening device for torpedo-mounted dispensers as in claim 7, wherein said contact is made at an edge of said slot, said edge having a slope in a plane of said inner support, said sloping contact wedging said inner support against a protrusion on said dispenser.

10. A shock-hardening device for torpedo-mounted dispensers as in claim 1, further comprising at least one stabilizer spanning between and connected to adjacent inner supports.

11. A shock-hardening device for torpedo-mounted dispensers as in claim 10 wherein said at least one inner support further comprises:

at least one tab extending radially outward from said at least one inner support;

a slot adjacent each said tab, each slot corresponding to a hook on said dispenser, the hook extending through said slot when said inner support is placed on said dispenser;

an eye bolt engaging said hook and extending through a bolt hole on said tab; and a nut engaging said extension of said eye bolt through said tab, tightening of said nut on said eye bolt against said tab bringing said inner support in contact with said hook, said contact serving to attach said inner support to the dispenser.

12. A shock-hardening device for torpedo-mounted dispensers as in claim 11, wherein said contact is made at an edge of said slot, said edge having a slope in a plane of said inner support, said sloping contact wedging said adjacent inner supports against protrusions on said dispenser.

13. A shock-hardening device for torpedo-mounted dispensers comprising:

at least one inner support circumferentially attached to a torpedo-mounted dispenser; and at least one shock-absorbing metal tube affixed to said inner support, each said shock-absorbing tube having its longitudinal axis bent to correspond with a radius of said dispenser, each tube being circumferentially affixed to said inner support, said shock-hardening device stiffening the torpedo-mounted dispenser so as to sustain a predefined value of a shock load without damage to the dispenser, said tubes deforming to prevent damage to the dispenser when the shock load exceeds the predefined value.

14. A shock-hardening device for torpedo-mounted dispensers as in claim 13, wherein said at least one inner support further comprises:

at least one tab extending radially outward from said at least one inner support;

a slot adjacent each said tab, each slot corresponding to a hook on said dispenser, the hook extending through said slot when said inner support is placed on said dispenser;

an eye bolt engaging said hook and extending through a bolt hole on said tab; and a nut engaging said extension of said eye bolt through said tab, tightening of said nut on said eye bolt against said tab bringing said inner support in contact with said hook, said contact serving to attach said inner support to the dispenser.

15. A shock-hardening device for torpedo-mounted dispensers as in claim 14, wherein said contact is made at an edge of said slot, said edge being chamfered to wedge said inner support beneath said hook.

16. A shock-hardening device for torpedo-mounted dispensers as in claim 14, wherein said contact is made at an edge of said slot, said edge having a slope in a plane of said inner support, said sloping contact wedging said inner support against a protrusion on said dispenser.

17. A shock-hardening device for torpedo-mounted dispensers as in claim 13, further comprising at least one stabilizer spanning between and connected to adjacent inner supports.

18. A shock-hardening device for a torpedo-mounted dispenser comprising:

at least one metal plate bent to correspond to a radius of said torpedo-mounted dispenser and circumferentially attached to the torpedo-mounted dispenser to serve as an inner support;

at least one metal shock-absorbing tube affixed to said inner support; and at least one outer support affixed to a diametrically opposite side of said at least one shock-absorbing tube from said inner support, said outer support being a metal plate bent to a radius corresponding with a radius of said torpedo-mounted dispenser plus a width of said at least one tube, said shock-hardening device stiffening the torpedo-mounted dispenser so as to sustain a predefined value of a shock load without damage to the dispenser, said tubes deforming to prevent damage to the dispenser when the shock load exceeds the predefined value.

19. A shock-hardening device for a torpedo-mounted dispenser as in claim 18, wherein each said shock-absorbing tube is fabricated with an elliptical cross section, said elliptical cross section preloading said tubes to deform at said predefined value of the shock load.

20. A shock-hardening device for a torpedo-mounted dispenser as in claim 18, wherein each end of each said shock absorbing tube is chamfered in a direction away from the torpedo-mounted dispenser and towards a center point of the tube, the chamfer being incorporated into edges of each outer support adjacent the tubes.

21. A shock-hardening device for a torpedo-mounted dispenser as in claim 18, further comprising at least one stabilizer spanning between and connected to adjacent inner supports.

* * * * *